US005242886A

United States Patent [19]

Sano et al.

[11] Patent Number: 5,242,886

[45] Date of Patent: Sep. 7, 1993

[54] PRESSURE-SENSITIVE RECORDING SHEET

[75] Inventors: Shojiro Sano; Masanobu Takashima, both of Shizuoka, Japan

[73] Assignee: Fuji Photo Film Co., Ltd., Kanagawa, Japan

[21] Appl. No.: 913,432

[22] Filed: Jul. 15, 1992

[30] Foreign Application Priority Data

Jul. 16, 1991 [JP] Japan ..... 3-199795
Jul. 26, 1991 [JP] Japan ..... 3-208899

[51] Int. Cl.[5] ..... B41M 5/145; B41M 5/165

[52] U.S. Cl. ..... 503/215; 427/152; 503/220; 503/221

[58] Field of Search ..... 427/150–152; 503/215, 220, 221

[56] References Cited

FOREIGN PATENT DOCUMENTS 0242170 10/1987 European Pat. Off. ..... 503/220

*Primary Examiner*—Pamela R. Schwartz
*Attorney, Agent, or Firm*—Sughrue, Mion, Zinn, Macpeak & Seas

[57] ABSTRACT

A pressure-sensitive recording sheet comprises a micro-encapsulated divinylphthalide compound represented by the following formula (I):

(1)

wherein the microcapsules have the following particle size distribution:

$4.0\ \mu m \leqq D_{50} \leqq 10.0\ \mu m$ $D_{90}/D_{10} \leqq 2.0.$

12 Claims, No Drawings

PRESSURE-SENSITIVE RECORDING SHEET

FIELD OF THE INVENTION

This invention relates to a pressure-sensitive recording sheet, and more particularly to a pressure-sensitive recording sheet suitable for use with optical character readers.

BACKGROUND OF THE INVENTION

With the development of bar code readers and optical character readers (OCR) using near infrared rays, optical character reading has been applied to pressure-sensitive recording sheets, etc. in recent years. In the case of pressure-sensitive recording sheets, heretofore, optical character readers have been used to read characters written or formed on the upper sheet. In general, however, they have not been suitable for or capable of reading characters formed by the rupture of microcapsules.

Recently, various color forming dyes capable of forming dyes having absorptions in the near infrared region have been proposed in JP-B-58-3940 corresponding to U.S. Pat. No. 4,020,056 (the term "JP-B" as used hereinafter means an "examined published Japanese patent application"), JP-A-60-230890 (the term "JP-A" as used hereinafter means an "unexamined published Japanese patent application") and JP-A-59-199757. When these dyes are used, the characters on several of the pressure-sensitive recording sheets (up to 5 to 6 sheets) can be read by the optical character reader, but there are problems in that these dyes are colored yellow, the background tends to fog, and the dyes' developability is poor. Accordingly, these dyes are unsuitable for practical use.

Recently, color forming divinyl compounds which absorb in the near infrared region and are free from the above-described problems have been proposed in JP-A-62-243653 corresponding to EP-A-242170.

When these divinyl compounds are microencapsulated and used as color formers, an improved pressure-sensitive recording sheet can be obtained on which the characters on all the paper sheets usually can be read by the optical character reader using near infrared rays. In some instances, however, it is difficult to read certain recorded characters depending on their forms, etc. Particularly, when the number of sheets is increased, the likelihood increases that the optical character reader cannot read the characters recorded on the forth, fifth, and subsequent sheets, fairly.

SUMMARY OF THE INVENTION

Accordingly, an object of the present invention is to provide a pressure-sensitive recording sheet which enables characters formed on all of many developer sheets to be read with optical character readers using near infrared rays when microcapsule sheets containing a divinyl compound (divinylphthalide compound) are used.

The present inventors have made extensive studies and have found that the above-described object of the present invention can be achieved by a pressure-sensitive recording sheet, comprising a support, an electron-accepting developer layer, and a substantially colorless electron-donating dye layer comprising a microencapsulated divinylphthalide compound represented by formula (I) which gives a developed color image by the reaction of the electron-donating dye with the electron-accepting developer, wherein a solution of the divinylphthalide compound dissolved in a hydrophobic liquid is enclosed as a core material in microcapsules, and the microcapsules have a particle size distribution within the range defined below:

(I)

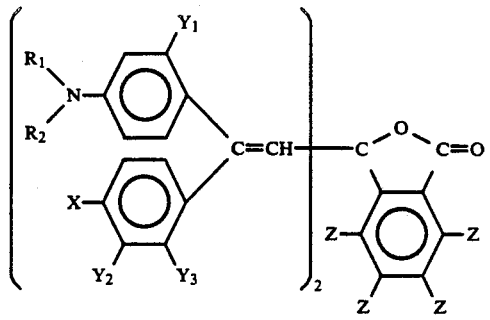

wherein $R_1$ and $R_2$ each represents an alkyl group having not more than 8 carbon atoms, a cycloalkyl group having 5 to 7 carbon atoms, a benzyl group which may be substituted by a halogen atom or an alkyl group having not more than 4 carbon atoms or a phenyl group which may be substituted by a halogen atom or an alkyl group having not more than 4 carbon atoms, or $R_1$ and $R_2$ may be bonded to form a ring together with the N to which they are bonded; X represents a hydrogen atom, a halogen atom, an alkyl group having not more than 8 carbon atoms, an alkoxy group having not more than 8 carbon atoms or $-NR_3R_4$, wherein $R_3$ and $R_4$ have the same meaning as $R_1$ and $R_2$; $Y_1$, $Y_2$ and $Y_3$ each represents a hydrogen atom, a halogen atom, an alkyl group having not more than 8 carbon atoms or an alkoxy group having not more than 8 carbon atoms; and Z represents a hydrogen atom, a chlorine atom or a bromine atom, and the article size distribution is as follows:

$$4.0\ \mu m \leqq D_{50} \leqq 10.0\ \mu m$$

$$D_{90}/D_{10} \leqq 2.0$$

wherein $D_{10}$, $D_{50}$ $D_{90}$ are each the percent particle diameter determined from a cumulative volume distribution:

$D_{10}$:cumulative 10% particle diameter $D_{50}$:cumulative 50% particle diameter $D_{90}$:cumulative 90% particle diameter It is preferred that the walls of the microcapsules of the present invention comprise a polyurethane resin.

In a preferred embodiments, the present invention comprises a pressure-sensitive recording sheet which gives a developed color image by the reaction of a substantially colorless electron-donating dye with an electron accepting developer, wherein the electron-accepting developer layer thereof contains a metal salt of an aromatic carboxylic acid, and the electron-donating dye layer thereof contains a divinylphthalide compound represented by formula (I) described above as the electron-donating dye.

In another preferred embodiment, a fluoran compound having an anilino group at the 2-position and a substituted amino group at the 6-position is encapsulated in the microcapsules with the divinylphthalide compound as a black color-forming compound.

DETAILED DESCRIPTION OF THE INVENTION

The present invention is described in detail below.

In the definition of formula (I), $R_1$ and $R_2$ each preferably represents a methyl group or an ethyl group.

When $R_1$ and $R_2$ (or $R_3$ and $R_4$) are bonded to form a ring together with the N to which they are bonded, a ring represented by the following formulae is formed:

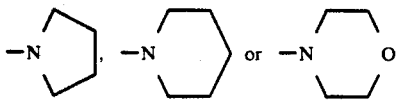

X preferably represents a hydrogen atom, a chlorine atom, an alkyl group having not more than 8 carbon atoms, an alkoxy group having not more than 3 carbon atoms or $—NR_3R_4$, more preferably, a methoxy group or $—NR_3R_4$.

$Y_1$, $Y_2$ and $Y_3$ each preferably represents a hydrogen atom, a chlorine atom, an alkyl group having not more than 4 carbon atoms or an alkoxy group having not more than 4 carbon atoms, more preferably, a hydrogen atom, a chlorine atom, a methyl group or a methoxy group.

Z preferably represents a hydrogen atom or a chlorine atom.

The divinylphthalide compounds of general formula (I) which are used in the present invention include some but not all of the compounds disclosed in the aforesaid JP-A-62-243653.

Preferred examples of divinylphthalide compounds of formula (I) which can be used in the present invention include but are not limited to the following compounds:

1.

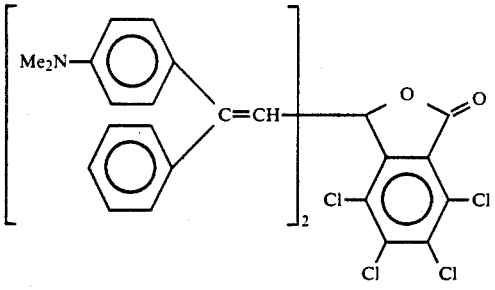

2.

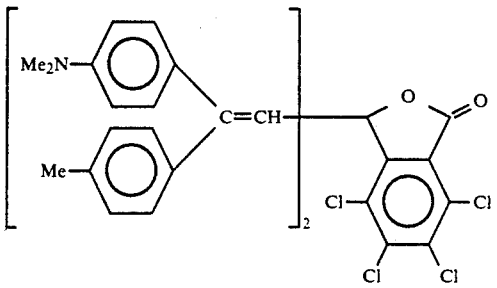

-continued

3.

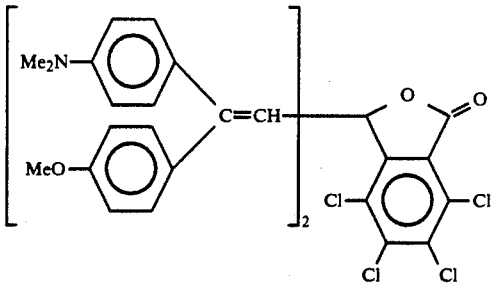

4.

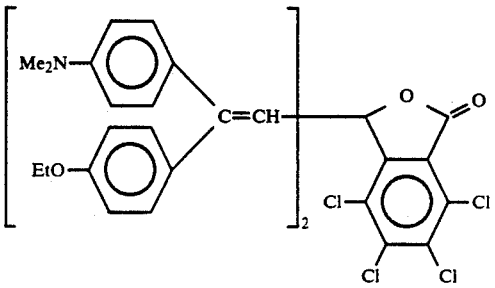

5.

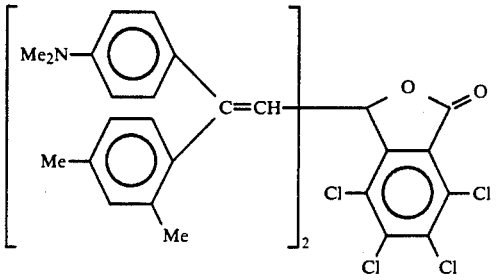

6.

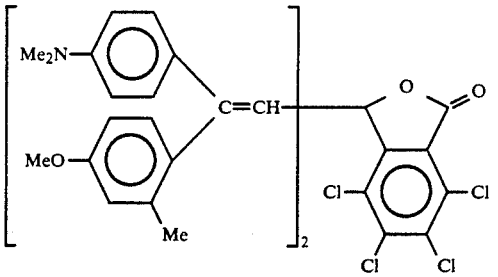

7.

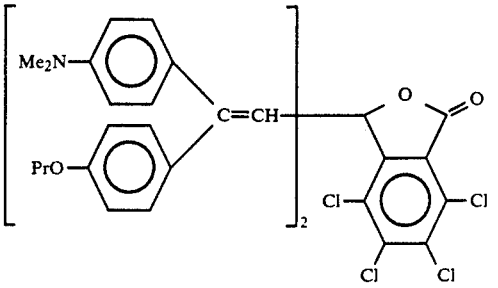

-continued
8.
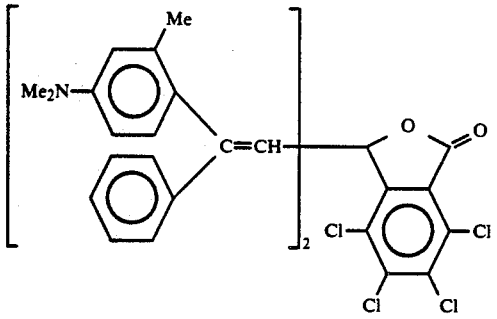
9.
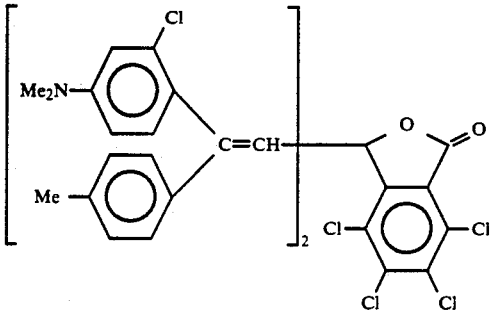
10.
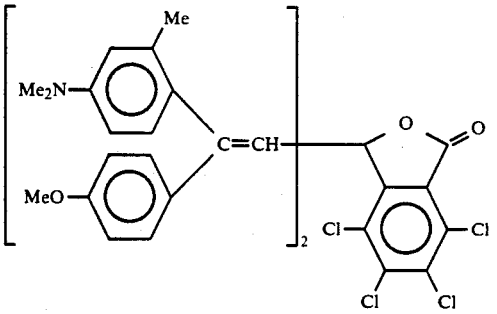
11.
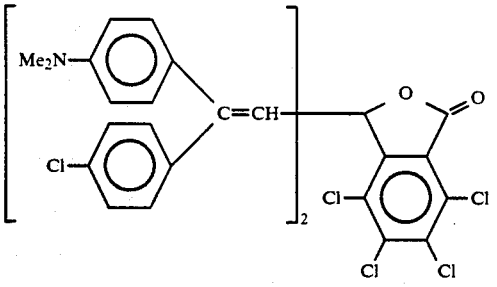
12.
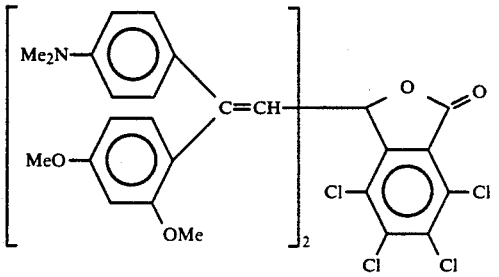
-continued
13.
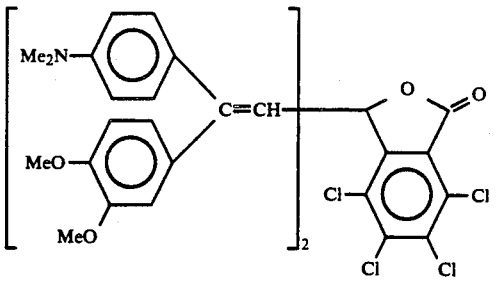
14.
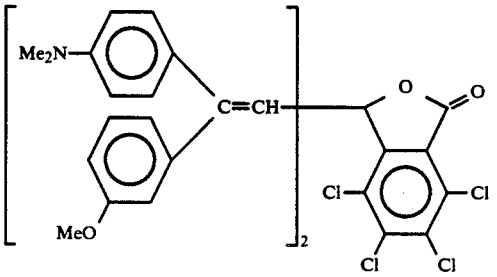
15.
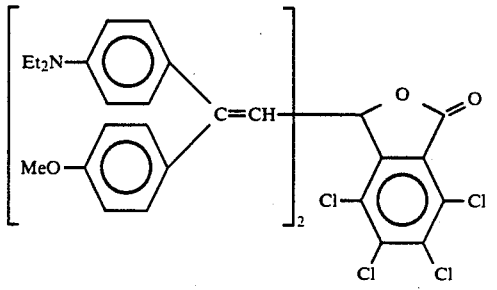
16.
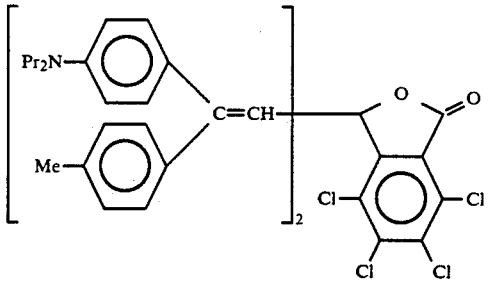
17.
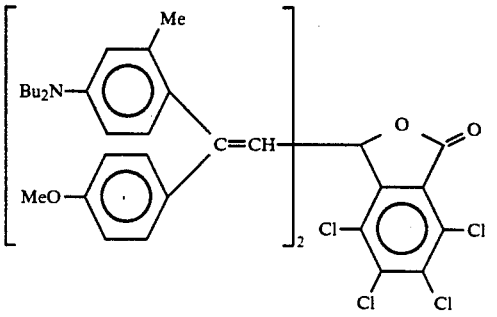

-continued
18.
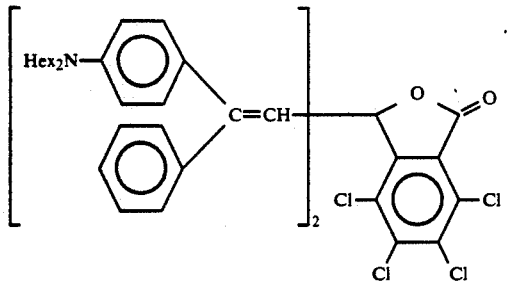
19.
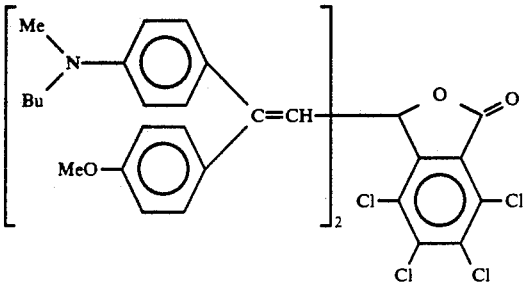
20.
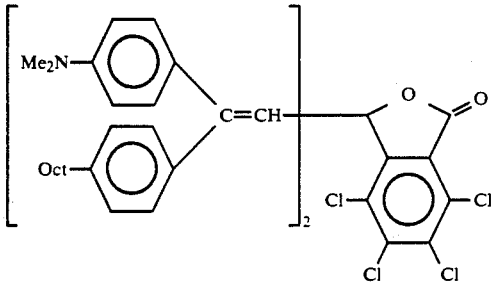
21.
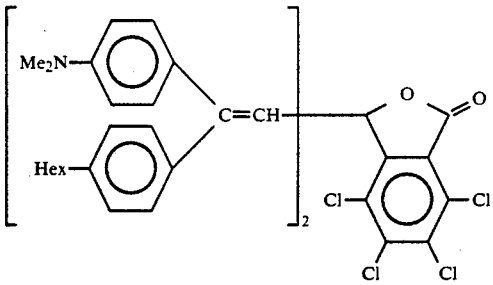
22.
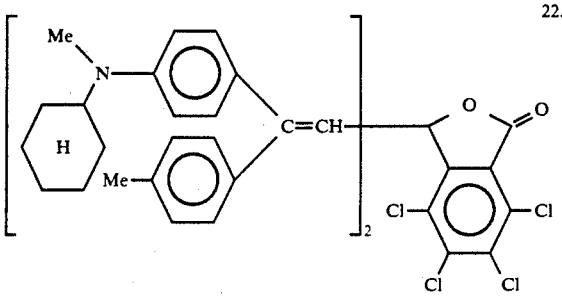
-continued
23.
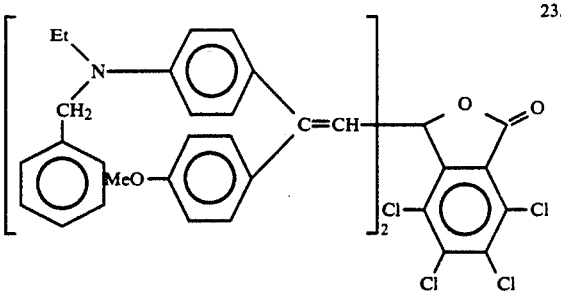
24.
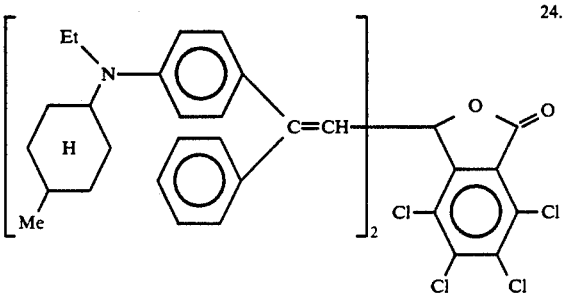
25.
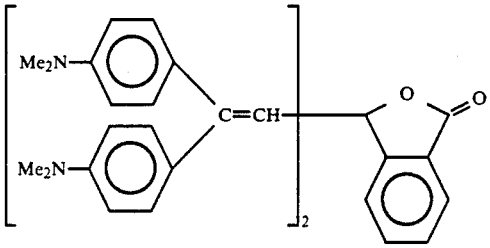
26.
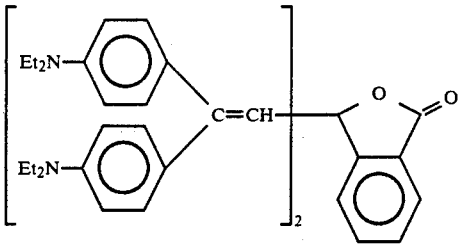
27.
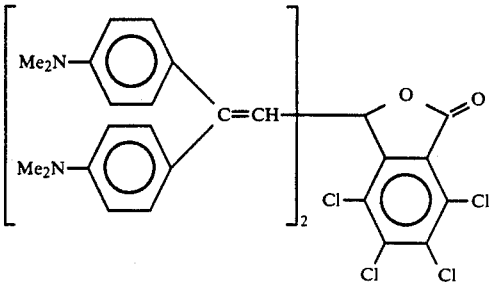

-continued

28.

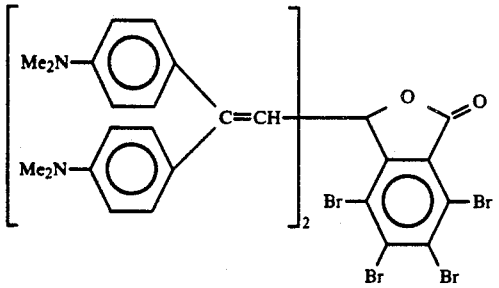

29.

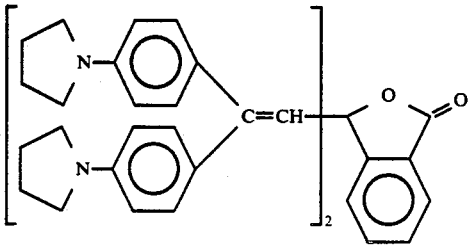

30.

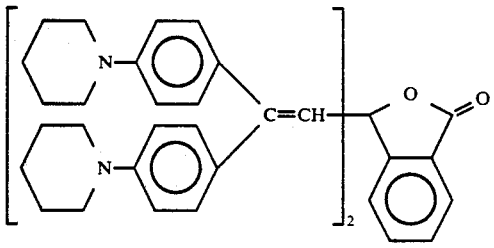

31.

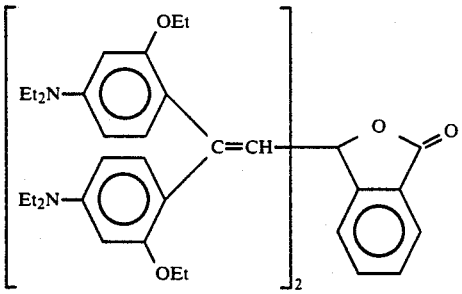

32.

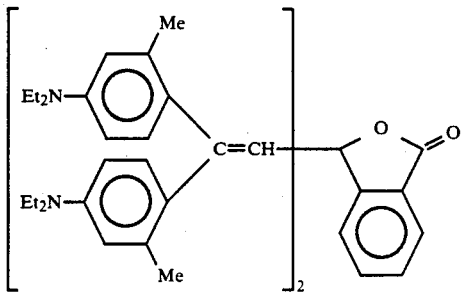

-continued

33.

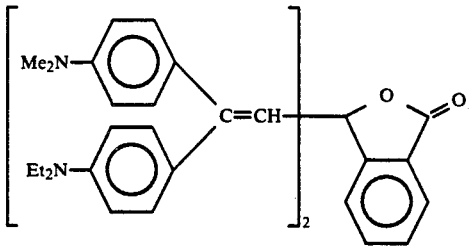

34.

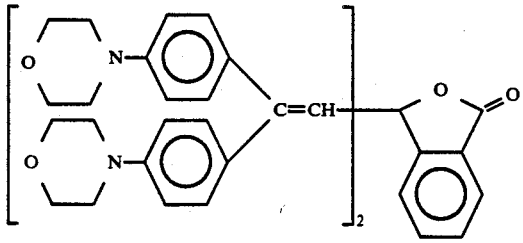

The microcapsules of the present invention preferably have a particle diameter distribution within the following range:

$$4.0\ \mu m \leqq D_{59} \leqq 10.0\ \mu m$$

$$D_{90}/D_{10} \leqq 2.0$$

wherein $D_{50}$ is the median size.

When $D_{50}$ is less than 4.0 μm, sufficient developability cannot be obtained. When $D_{50}$ is greater than 10.0 μm, sufficient pressure resistance cannot be obtained and the form of the resulting image is unsuitable to be read using an OCR. The preferred range for $D_{50}$ is from 6.5 to 8.5 μm.

$D_{90}/D_{10}$ represents the breadth of the particle diameter distribution. A smaller $D_{90}/D_{10}$ value represents a narrower particle diameter distribution.

The present inventors have found that when $D_{50}$ is within the above range and $D_{90}/D_{10}$ is less than or equal to 2, the recorded images (characters) on all sheets have a form which can be read using an OCR even when recording is made on a plurality of pressure-sensitive recording sheets.

Microcapsules having a particle diameter distribution as described above can be obtained by conducting emulsification with a shearing emulsification type double cylindrical emulsifier (cylindrical mill) having a uniform gap.

The microcapsules having a polyurethane resin wall which are preferably used in the present invention can be obtained by dissolving a polyisocyanate, a polyhydroxy compound and a color former in a hydrophobic liquid, emulsifying and dispersing the resulting solution in a hydrophilic liquid and adding a polyamine to the resulting emulsified dispersion to cover the hydrophobic liquid droplets with a polyurethane resin. In some cases, either the polyhydroxy compound or the polyamine may be omitted.

Both the polyisocyanate and the polyhydroxy compounds which can be used in the present invention are described in JP-A-2-160579.

It is preferred that a fluoran compound be used as a black color forming agent together with the dye of formula (I) when it is intended that the pressure-sensitive recording sheets will be read with an optical character reader and the resulting records will also be read with the naked eye.

Fluoran compounds preferred for use in the present invention are represented by the following formula (II).

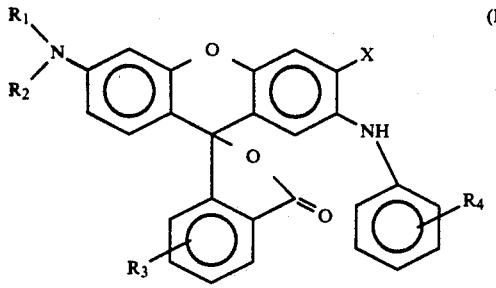

(II)

wherein $R_1$, $R_2$ and $R_3$ each represents an alkyl group having 1 to 10 carbon atoms; $R_4$ represents a hydrogen atom or an alkyl group having 1 to 8 carbon atoms; and X represents an alkyl group having 1 to 8 carbon atoms or a chlorine atom.

In formula (II), the alkyl groups represented by $R_1$ and $R_2$ may be combined together to form a ring, or may be optionally substituted. Compounds where X is a methyl group or a chlorine atom are preferred. Examples of these colorless or light color electron-donating dye precursors include, but are not limited to, the following compounds:

2-Anilino-3-methyl-6-dimethylaminofluoran
2-Anilino-3-methyl-6-N-methyl-N-ethylaminofluoran
2-Anilino-3-methyl-6-N-methyl-N-(isopropyl)aminofluoran
2-Anilino-3-methyl-6-N-methyl-N-pentylaminofluoran
2-Anilino-3-methyl-6-N-methyl-N-cyclohexylaminofluoran
2-Anilino-3-methyl-6-diethylaminofluoran
2-Anilino-3-chloro-6-dimethylaminofluoran
2-Anilino-3-methyl-6-N-ethyl-N-isoamylaminofluoran
2-Anilino-3-methyl-6-N-methyl-N-isoamylaminofluoran
2-Anilino-3-chloro-6-diethylaminofluoran
2-Anilino-3-chloro-6-N-methyl-N-ethylaminofluoran
2-Anilino-3-chloro-6-N-methyl-N-(isopropyl)aminofluoran
2-Anilino-3-chloro-6-N-methyl-N-pentylaminofluoran
2-Anilino-3-chloro-6-N-methyl-N-cyclohexylaminofluoran
2-Anilino-3-methyl-6-N-ethyl-N-pentylaminofluoran
2-Anilino-3-chloro-6-N-ethyl-N-pentylaminofluoran
2-(p-Methylanilino)-3-methyl-6-dimethylaminofluoran
2-(p-Methylanilino)-3-methyl-6-diethylaminofluoran
2-(p-Methylanilino)-3-methyl-6-N-methyl-N-ethylaminofluoran
2-(p-Methylanilino)-3-methyl-6-N-methyl-N-(isopropyl)aminofluoran
2-(p-Methylanilino)-3-methyl-6-N-methyl-N-pentylaminofluoran
2-(p-Methylanilino)-3-methyl-6-N-methyl-N-cyclohexylaminofluoran
2-(p-Methylanilino)-3-methyl-6-N-ethyl-N-pentylaminofluoran
2-(p-Methylanilino)-3-chloro-6-dimethylaminofluoran
2-(p-Methylanilino)-3-chloro-6-diethylaminofluoran
2-(p-Methylanilino)-3-chloro-6-N-methyl-N-ethylaminofluoran
2-(p-Methylanilino)-3-chloro-6-N-methyl-N-(isopropyl)aminofluoran
2-(p-Methylanilino)-3-chloro-6-N-methyl-N-cyclohexylaminofluoran
2-(p-Methylanilino)-3-chloro-6-N-methyl-N-pentylaminofluoran
2-(p-Methylanilino)-3-chloro-6-N-ethyl-N-pentylaminofluoran
2-Anilino-3-methyl-6-N-methyl-N-furylmethylaminofluoran
2-Anilino-3-ethyl-6-N-methyl-N-furylmethylaminofluoran.

The color former of the present invention is dissolved in a solvent, encapsulated and coated on a support optionally together with the above-described fluoran compound.

The hydrophobic liquids (solvents) which can be used in the present invention includes natural oils and synthetic oils. They may be used singly or in combination. Examples of suitable solvents include cotton seed oil, kerosine, paraffin, naphthenic oil, alkylated biphenyls, alkylated terphenyls, chlorinated paraffin, alkylated naphthalenes and diphenylalkanes.

Methods for preparing the color former-containing microcapsules include interfacial polymerization methods, internal polymerization methods, phase separation methods, external polymerization methods and coacervation methods.

Generally, water-soluble binders or latex binders are used to prepare a coating solution containing the color former-containing microcapsules. Further, a protective agent for the capsules, such as cellulose powder, starch granules or talc may be added to the coating solution containing the color former-containing microcapsules.

Examples of the developer which is reacted with the color former used in the present pressure-sensitive recording sheet include clay materials such as terra abla, activated clay, attapulgite, zeolite, bentonite and kaolin, metal salts of aromatic carboxylic acids and phenolic resins.

The metal salts of aromatic carboxylic acids are preferred developers for pressure-sensitive recording sheets containing the divinylphthalide compounds of formula (I), said pressure-sensitive recording sheet enabling characters on all paper to be read with an optical character reader using near infrared rays without causing the decomposition of the developed color image even when exposed to light.

Examples of metal salts of aromatic carboxylic acids preferred for use in the present invention include zinc salts, nickel salts, aluminum salts and calcium salts of 3,5-di-t-butylsalicylic acid, 3,5-di-t-octylsalicylic acid, 3,5-di-t-nonylsalicylic acid, 3,5-di-t-dodecylsalicylic acid, 3-methyl-5-t-dodecylsalicylic acid, 3-t-dodecylsalicylic acid, 5-t-dodecylsalicylic acid, 5-cyclohexylsalicylic acid, 3,5-bis(α-methylbenzyl)salicylic acid, 3,5-bis(α,α-dimethylbenzyl)salicylic acid, 3-methyl-5-(α-methylsalicylic acid, 3-(α,α-dimethylbenzyl)-6-methylsalicylic acid, 3-(α-methylbenzyl)-5-(α,α-dimethylbenzyl)salicylic acid, 3-(α,α-dimethylbenzyl)-6-ethylsalicylic acid, 3-phenyl-5-(α,α-dimethylbenzyl)-salicylic acid, carboxy-modified terpene phenol resins and a salicylic acid resin which is the reaction product of 3,5-bis(α-methylbenzyl)salicylic acid with benzyl chloride.

These metal salts of aromatic carboxylic acids are preferably dissolved in organic solvents for use in the invention. Examples of suitable organic solvents include toluene, xylene, methyl ethyl ketone, methyl isobutyl ketone, diisobutyl ketone, ethyl acetate, butyl acetate, amyl acetate, methylene chloride, butanol, paraffin and kerosine.

The amount of the metal salts of an aromatic carboxylic acid to be dissolved in the organic solvent is preferably 10 to 200% by weight based on the amount of the organic solvent.

The resulting organic solvent solution is emulsified and dispersed in water containing a dispersant in an amount of 5 to 120% by weight, preferably 50 to 100% by weight based on the amount of water containing a dispersant. Subsequently, the resulting emulsified dispersion is heated to drive off the organic solvent, thus giving a developer dispersion.

Ionic or nonionic surfactants and water-soluble polymers can be used as the dispersant. Examples of suitable surfactants include alkylbenzenesulfonates, alkylnaphthalenesulfonates, alkylsulfonates, dialkyl sulfosuccinates, polyoxyethylene alkyl ethers, polyoxyethylene alkylphenyl ethers and partial esters derived from polyhydric alcohol fatty acids. Examples of suitable water-soluble polymers include polyvinyl alcohol, modified polyvinyl alcohol, polyacrylamide, sodium polyacrylate, polyvinyl ether, sodium polystyrenesulfonate and maleic anhydride copolymers.

Examples of binders which can be used in the coating solution include latexes such as styrene-butadiene copolymer latex, vinyl acetate latex and acrylate latex and synthetic and natural polymers such as polyvinyl alcohol, polyacrylic acid, maleic anhydridestyrene copolymer, starch, casein, gum arabic, gelatin, carboxymethyl cellulose and methyl cellulose.

The final amounts of the compound of formula (I), the flouran compound, the microcupsules and the developer to be coated on the support are 0.1 to 3.0 g/m$^2$, preferably 0.2 to 1.5 g/m$^2$, 0.1 to 3.0 g/m$^2$, preferably 0.2 to 1.5 g/m$^2$, 0.5 to 6.0 g/m$^2$, preferably 1.0 to 3.0 g/m$^2$ and 0.1 to 3.0 g/m$^2$, preferably 0.2 to 1.0 g/m$^2$, respectively.

The present invention is now illustrated in greater detail by reference to the following examples which, however, are not to be construed as limiting the invention.

In the following examples, parts are by weight unless otherwise stated.

EXAMPLE 1

Preparation of developer sheet

Preparation of dispersion 15 parts of zinc 3,5-di-α-methylbenzylsalicylate, 120 parts of calcium carbonate, 30 parts of activated clay, 20 parts of zinc oxide, 1 part of sodium hexametaphosphate and 200 parts of water were uniformly dispersed in a sand grinder so as to give an average particle size of 3 μm, thus obtaining a dispersion (A).

Preparation of coating solution

To 400 parts of the dispersion (A) were added 10 parts of 10% PVA-203 (a product of Kuraray Co., Ltd.) solution, 100 parts of a 100% PVA-117 (a product of Kuraray Co., Ltd.) solution and 10 parts (on a solid basis) of carboxy-modified SBR latex (SN-307, a product of Sumitomo Naugatuc Co., Ltd.) were added. Water was added to the mixture to give a solids concentration of 20%, thus obtaining a coating solution.

Coating of developer sheet

The coating solution was coated using an air knife coater on raw paper weighing 50 g/m$^2$ to give a coating weight of 5.0 g/m$^2$ on a solids basis. The coating solution was dried to obtain a developer sheet.

The thus-obtained developer sheet was used in Examples 1 to 3 and Comparative Examples 1 to 3.

Preparation of microcapsule sheet 2000 g of 1-phenoxy-1-xylylethane were dissolved in 120 g of 3,3-bis[2-(p-dimethylaminophenyl)-2-(p-methoxyphenyl)ethenyl]-4,5,6,7-tetrachlorophthalide, 100 g of 2-anilino-3-methyl-6-N-ethyl-N-isopentylaminofluoran, 40 g of 2-benzylamino-6-diethylaminofluoran and 20 g of bisindoylphthalide having the following structural formula as color formers.

Bisindoylphthalide

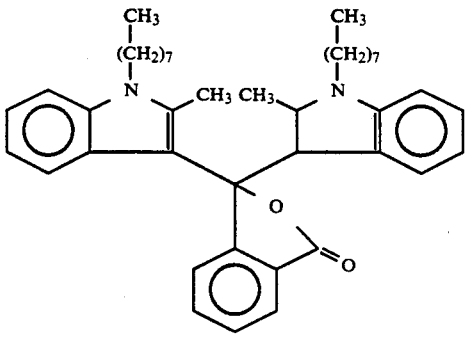

160 g of polymethylene polyphenyl isocyanate (trade name: Millionate MR200, manufactured by Nippon Polyurethane IND. Co., Ltd.) and 140 g of biuret of hexamethylene diisocyanate (trade name: Sumidur N3200, manufactured by Sumitomo Bayer Urethane Co., Ltd.) as the polyisocyanate and 64 g of butylene oxide adduct of ethylenediamine (moles of butylene oxide added to ethylenediamine: 16.8 moles, molecular weight: 1267) as the alkylene oxide adduct of amine were dissolved in the resulting oily solution to prepare a first solution.

Separately, 200 g of polyvinyl alcohol and 100 g of carboxymethyl cellulose were dissolved in 2800 g of water to prepare a second solution.

While the second solution was stirred using a propeller agitator having a blade size of 70 mm at 800 rpm, the first solution was added thereto to form an oil-in-water emulsion, thus obtaining a pre-emulsion.

The pre-emulsion was treated using a cylindrical mill under such conditions that the flow rate was 0.3 kg/min, the clearance was 300 μ, the number of revolutions was 1300 rpm. After 2000 g of water at 20° C. was added to the emulsion, the temperature of the mixture was gradually raised to 65° C. and the mixture was kept at 65° C. for 90 minutes to obtain a capsule solution.

The particle size distribution of the capsules was measured with coultar counter TA-II. It was found that $D_{50}$ was 6.6 μm and $D_{90}/D_{10}$ was 1.70.

2000 g of a 15% aqueous solution of polyvinyl alcohol, 600 g (on a solids basis) of carboxy-modified SBR latex and 1200 g of starch granules (average granule size = 15 μm) were added to the thus-obtained capsule solution.

Subsequently, water was added thereto to adjust the solids concentration to 20% to thereby prepare a coating solution.

The coating solution was coated using an air knife coater on raw paper weighing 40 g/m$^2$ to give a coating weight of 4.0 g/m$^2$ on a dry basis and dried to obtain a microcapsule sheet.

EXAMPLE 2

The procedure of Example 1 was repeated except that the pre-emulsion was treated using the cylindrical mill under such conditions that the flow rate was 0.4 kg/min, the clearance was 500 μ, the number of revolutions was 1200 rpm.

The particle size distribution of the capsules was measured using a coultar counter TA-II. It was found that $D_{50}$ was 8.0 μm and $D_{90}/D_{10}$ was 1.74.

COMPARATIVE EXAMPLE 1

While the second solution of Example 1 was stirred in a dissolver having a blade size of 100 mm at 2000 rpm, the first solution of Example 1 was added thereto and stirring was continued for one minute to form an oil-in-water emulsion. After 2000 g of water at 20° C. was added to the emulsion, the temperature of the mixture was gradually raised to 65° C., and the mixture was kept at 65° C. for 90 minutes to obtain a capsule solution.

The particle size distribution of the capsules was measured using a coultar counter TA-II. It was found that $D_{50}$ was 6.7 μm and $D_{90}/D_{10}$ was 3.0.

2000 g of a 15% aqueous solution of polyvinyl alcohol, 600 g (on a solids basis) of carboxy-modified SBR latex and 1200 g of starch granules (average granule size: 15 μm) were added to the thus-obtained capsule solution.

Subsequently, water was added thereto to adjust the solids concentration to 20% to thereby prepare a coating solution.

The coating solution was coated using an air knife coater on raw paper weighing 40 g/m$^2$ to give a coating weight of 4.0 g/m$^2$ on a dry basis and dried to obtain a microcapsule sheet.

COMPARATIVE EXAMPLE 2

While the second solution of Example 1 was stirred in a dissolver having a blade size of 100 mm at rpm, the first solution of Example 1 was added thereto and stirred for one minute to form an oil-in-water emulsion. After 2000 g of water at 20° C. was added to the emulsion, the temperature of the mixture was gradually raised to 65° C., and the mixture was kept at 65° C. for 90 minutes to obtain a capsule solution.

The particle size distribution of the capsules was measured using a coultar counter TA-II. It was found that $D_{50}$ was 7.9 μm and $D_{90}/D_{10}$ was 4.3.

2000 g of a 15% aqueous solution of polyvinyl alcohol, 600 g (on a solids basis) of carboxy-modified SBR latex and 1200 g of starch granules (average granule size: 15 μm) were added to the thus-obtained capsule solution.

Subsequently, water was added thereto to adjust the solids concentration to 20% to thereby prepare a coating solution.

The coating solution was coated using an air knife coater on raw paper weighing 40 g/m$^2$ to give a coating weight of 4.0 g/m$^2$ on a solids basis and dried to obtain a microcapsule sheet.

EXAMPLE 3

100 g of 3,3-bis[2-(p-dimethylaminophenyl)-2-(p-methoxyphenyl)ethenyl]-4,5,6,7-tetrachlorophthalide, 50 g of Crystal Violet lactone, 10 g of benzoylleuco methylene blue, 40 g of 3-[4-(dimethylamino)-2-ethoxyphenyl]-3-(2-methyl-1-ethyl-3-indolyl)-4-azaphthalide and 80 g of 2-anilino-3-methyl-6-N-ethyl-N-isopentylaminofluoran were dissolved in 2000 g of diisopropylnaphthalene.

200 g of ethyl acetate were added to the resulting oily solution, and to 320 g of tolylene diisocyanate (3 mol)/trimethylol propane (1 mol) adduct (trade name: Vernock manufactured by Dainippon Ink & Chemicals Inc.) as the polyisocyanate and 80 g of a butylene oxide adduct of ethylenediamine (moles of butylene oxide added to ethylenediamine: 12 moles, molecular weight: 924) as the alkylene oxide adduct of amine were dissolved in the resulting mixture to prepare a first solution.

Separately, 200 g of polyvinyl alcohol and 40 g of gum arabic were dissolved in 2800 g of water to prepare a second solution.

While the second solution was stirred in a propeller agitator having a blade size of 70 mm at 800 rpm, the first solution was added thereto to form an oil-in-water emulsion, thus obtaining a pre-emulsion.

The pre-emulsion was treated in a cylindrical mill under such conditions that the flow rate was 0.3 kg/min, the clearance was 300 μ, the number of revolutions was 1300 rpm. 2000 g of water at 20° C. and 7.2 g of diethylenetriamine as the polyamine were added to the emulsion. After the mixture was stirred at room temperature for 10 minutes, the temperature of the mixture was gradually raised to 65° C., and the mixture was kept at that temperature for 60 minutes.

The particle size distribution of the capsules was measured using a coultar counter TA-II. It was found that $D_{50}$ was 7.1 μm and $D_{90}/D_{10}$ was 1.71.

1600 g of a 15% aqueous solution of polyvinyl alcohol, 400 g (on a solids basis) of carboxy-modified SBR latex and 1000 g of starch granules (average granule size: 15 μm) were added to the thus-obtained capsule solution.

Subsequently, water was added thereto to adjust the solids concentration to 20% to thereby prepare a coating solution.

The coating solution was coated using an air knife coater on raw paper weighing 40 g/m$^2$ to give a coating weight of 4.0 g/m$^2$ on a dry basis and dried to obtain a microcapsule sheet.

COMPARATIVE EXAMPLE 3

While the second solution of Example 3 was stirred in a dissolver having a blade size of 100 mm at 2000 rpm, the first solution of Example 3 was added thereto and stirring was continued for one minute to form an oil-in-water emulsion.

2000 g of water at 20° C. and 7.2 g of diethylenetriamine as the polyamine were added to the emulsion. After the mixture was stirred at room temperature for 10 minutes, the temperature of the mixture was gradually raised to 65° C., and the mixture was kept at that temperature for 60 minutes.

The particle size distribution of the capsules was measured using a coultar counter TA-II. It was found that $D_{50}$ was 7.1 μm and $D_{90}/D_{10}$ was 3.3.

1600 g of a 15% aqueous solution of polyvinyl alcohol, 400 g (on a solids basis) of carboxy-modified SBR latex and 1000 g of starch granules (average granule size: 15 μm) were added to the thus-obtained capsule solution.

Subsequently, water was added thereto to adjust the solids concentration to 20%, thus obtaining a coating solution.

The coating solution was coated using an air knife coater on raw paper weighing 40 g/m² to give a coating weight of 4.0 g/m² on a solids basis and dried to obtain a microcapsule sheet.

The microcapsule sheets and the developer sheets described in Examples 1-3 and Comparative Examples 1-3 were combined and tested to evaluate them as pressure-sensitive recording sheets. The results are shown below in Table 1. The evaluation testing was done in the following manner.

(1) Preparation for reading with optical character reader

Each color former-containing microcapsule sheet was placed under three sheets of raw paper weighing 50 g/m², and the corresponding developer sheet was placed under the microcapsule sheet to make a sample composed of a set of 5 sheets. English characters and numerals in the OCR-B font style were written on each sample composed of a set of five sheets.

(2) Unevenness of line edge

The unevenness of the line edges of the sets of samples obtained in the above item (1) were checked using a COL gauge and a magnifying glass to determine whether the unevenness was within the tolerable range (JIS X9004).

(3) Reading Test with OCR

The reading test of the sets of samples obtained in the above item (1) was done using an OCR (Optical Character Reader V-3010 manufactured by Toshiba Corporation, using a blue color fluorescent lamp).

TABLE 1

| | Unevenness of Line Edge[a] | Reading with OCR[b] |
|---|---|---|
| Example 1 | ○ | ○ |
| Example 2 | ○ | ○ |
| Example 3 | ○ | ○ |
| Comp. Ex. 1 | X | X |
| Comp. Ex. 2 | X | X |
| Comp. Ex. 3 | X | X |

[a]○: tolerable
X: not tolerable
[b]○: readable
X: not readable

It is apparent from the results in Table 1 that when written characters are formed on the pressure-sensitive recording sheets of the present invention, the characters on the lowermost sheet of a sample composed of a set of five sheets can be read with OCR even when exposed to light.

EXAMPLES 4-1 to 4-4

Preparation of microcapsule sheet 6 parts of 3,3-bis[2-(p-dimethylaminophenyl)-2-(p-methoxyphenyl)ethyl]-4,5,6,7-tetrachlorophthalide, 6 parts of 2-anilino-3-methyl-6N-ethyl-N-isopentylaminofluoran, 1.5 parts of 2-dibenzylamino-6-diethylaminofluoran aminofluoran and 1.0 part of 3-chloro-6-cyclohexylaminofluoran as color formers were dissolved in 100 parts of diisopropylnaphthalene. The resulting oily color former solution was emulsified and dispersed in 100 parts of a 4.4% aqueous solution of a partial sodium salt of polyvinylbenzenesulfonic acid (average molecular weight: 500,000) adjusted to pH 4 to thereby obtain an emulsion having an average particle size of 4.5 μm. Separately, 6 parts of melamine, 11 parts of a 37 wt% aqueous solution of formaldehyde and 30 parts of water were stirred with heating to 60° C. After 30 minutes, a clear aqueous solution of a mixture of melamine, formaldehyde and a melamine-formaldehyde primary condensation was obtained. The pH of the mixed aqueous solution was 6.0 to 8.0. The aqueous solution of a mixture of melamine, formaldehyde and a melamine-formaldehyde primary condensation is hereinafter referred to as the primary condensation solution. The primary condensation solution was mixed with the above emulsified mixture. While stirring the resulting mixture, the pH of the mixture was adjusted to 6.0 with a 3.6 wt% hydrochloric acid solution. The temperature of the mixture was raised to 65° C., and the mixture was stirred continuously for 360 minutes. The resulting capsule solution was cooled to room temperature, and the pH of the solution was adjusted to 9.0 with a 20 wt% sodium hydroxide solution.

100 parts of a 10 wt% aqueous solution of polyvinyl alcohol, 10 parts (on a solids basis) of carboxy-modified SBR latex, 50 parts of starch granules and 10 parts of calcium carbonate were added to the capsule dispersion. Water was then added thereto so as to adjust the solids concentration to 20%, thus preparing a color former-containing microcapsule coating solution.

The coating solution was coated using an air knife coater on raw paper weighing 50 g/m² to give a coating weight of 5 g/m² on a solids basis and dried to obtain a microcapsule sheet for pressure-sensitive paper.

Preparation of developer sheet

Developer sheet A-1

Preparation of emulsion (A)

10 parts of zinc 3,5-bis(α-methylbenzyl)salicylate were added to 20 parts of 1-isopropylphenyl-2-phenylethane and the mixture was heated at 90° C. to dissolve the zinc compound. The mixture was then added to 50 parts of a 20% aqueous solution of polyvinyl alcohol (PVA-205 manufactured by Kuraray Co., Ltd.). Further, 0.1 part of a 10% aqueous solution of sodium sulfosuccinate as a surfactant was added thereto, and the mixture was mixed in a homogenizer to prepare a uniform emulsion (A) having an average particle size of 3 μm.

Preparation of dispersion (A)

Separately 5 parts of zinc 3,5-bis(α-methyl-benzyl)-salicylate, 170 parts of calcium carbonate, 20 parts of zinc oxide and 1 part of sodium hexametaphosphate were uniformly dispersed in 200 parts of water in a sand grinder to obtain a dispersion (A) having an average particle size of 3 μm.

Preparation of coating solution

Subsequently, 40 parts of emulsion (A) were mixed with 200 parts of dispersion (A). 100 parts of a 10% aqueous solution of PVA-117 (manufactured by Kuraray Co., Ltd.) and 10 parts (on a solids basis) of carboxy-modified SBR latex (SN-307 manufactured by Sumitomo Naugatuc Co., Ltd.) were added to the resulting mixed solution and then water was added to give a solids concentration of 20%, thus obtaining a coating solution.

Preparation of developer sheet

The coating solution was coated using an air knife coater on raw paper weighing 50 g/m$^2$ to give a coating weight of 5.0 g/m$^2$ on a solids basis and dried to obtain developer sheet A-1.

Developer sheet A-2

Developer sheet A-2 was prepared in the same manner as developer sheet A-1 except that zinc 3,5-di-t-octylsalicylate was used in place of the zinc 3,5-bis($\alpha$-methylbenzyl)salicylate used in developer sheet A-1.

Developer sheet A-3

Developer sheet A-3 was prepared in the same manner as developer sheet A-1 except that zinc 5-$\alpha$-($\alpha$-methylbenzyl)phenethylsalicylate was used.

Developer sheet A-4

Preparation of dispersion 15 parts of zinc 3,5-di-t butylsalicylate, 150 parts of calcium carbonate, 2 parts of activated clay, 20 parts of zinc oxide and 1 part of sodium hexametaphosphate were uniformly dispersed in 200 parts of water in a sand grinder to obtain a dispersion (B) having an average particle size of 3 $\mu$m.

Preparation of coating solution 10 parts of a 10% aqueous solution of PVA-203 (manufactured by Kuraray Co., Ltd.), 100 parts of a 10% aqueous solution of PVA-117 (manufactured by Kuraray Co., Ltd.) and 10 parts (on a solids basis) of carboxy-modified SBR latex (SN-307 manufactured by Sumitomo Naugatuc Co., Ltd.) were added to 400 parts of dispersion (B) and then water was added thereto to give a solids concentration of 20%, thus obtaining a coating solution.

Preparation of developer sheet

The coating solution was coated using an air knife coater on raw paper weighing 50 g/m$^2$ to give a coating weight of 5.0 g/m$^2$ on a solids basis and dried to obtain developer sheet A-4.

The developer sheets and the color former-containing microcapsule sheet were combined and tested to evaluate them as a pressure-sensitive recording sheet. The results are shown below in Table 2. The evaluation test was done in the following manner:

(1) Measurement of PCS (Print Contrast Signal) value

The microcapsule layer of the color former-containing microcapsule sheet was placed on the developer sheet, and a load of 300 kg/cm$^2$ was applied thereto to develop a color. After the laminate was left to stand in darkness for 24 hours, the reflectance of the developed color surface at 380 to 1000 nm was measured with a spectrophotometer (UV-3100, manufactured by Shimadzu Corporatoin), and the PCS value was calculated using the following formula:

*PCS* value = (reflectance of white background − reflectance of developed color image) ÷ (reflectance of white background)

(2) Test of light resistance of developed color image

The developed color image obtained in the above item (1) was irradiated with a fluorescent lamp fadeometer (33,000 lux) for 16 hours. Subsequently, the PCS value was measured in the same manner as in item (1).

(3) Reading test with OCR

The microcapsule layer of the color former-containing microcapsule sheet was placed on the developer sheet. English characters and numerals in the OCR-B font style were written on the sample. The reading test of the set sample was done using an OCR (optical character reader, V-3010 manufactured by Toshiba Corporation, using blue color fluorescent lamp).

Further, the set characters were irradiated with a fluorescent lamp fadeometer (33,000 lux) for 16 hours, and the reading test in the manner described above was carried out using an OCR.

COMPARATIVE EXAMPLES 4 AND 5

The microcapsule sheet obtained in Examples 4-1 to 4-4 was combined with the following developer sheet B (Comparative Example 4) or developer sheet C (Comparative Example 5). A test was conducted in the same manner as in Examples 4-1 to 4-4 The results are shown below in Table 2.

Developer sheet B 10 parts of p-phenylphenol resin, 100 parts of calcium carbonate, 20 parts of aluminum hydroxide and 1 part of sodium hexametaphosphate were dispersed in 200 parts of water in a Kedy mill.

The dispersion was uniformly dispersed in a sand mill so as to give a volume-average particle size of 3 $\mu$m. 50 parts of a 10% aqueous solution of oxidized starch and 10 parts (on a solids basis) of carboxy-modified SBR latex were added to the resulting dispersion and then water was added thereto to give a solids concentration of 20%, thus obtaining a coating solution.

The coating solution was coated using an air knife coater on raw paper weighing 50 g/m$^2$ to give a coating weight of 6 g/m$^2$ on a solids basis and dried to obtain developer sheet B.

Developer sheet C 200 parts of activated clay were dispersed in 800 parts of water, and the pH of the dispersion was adjusted to 10.0 with a 20% aqueous solution of sodium hydroxide. 40 parts (on a solids basis) of a styrene-butadiene copolymer latex having a styrene content of 60 mol% and 60 parts of a 10% aqueous solution of starch were added to the dispersion to obtain a coating solution. The coating solution was coated using an air knife coater on raw paper weighing 50 g/m$^2$ to give a coating weight of 6 g/m$^2$ on a solids basis and dried to obtain developer sheet C.

EXAMPLES 5-1 TO 5-3

Preparation of microcapsule sheet

A microcapsule sheet was prepared in the same manner as the microcapsule sheet of Examples 4-1 to 4-4 except that a color former solution of 6 parts of 3,3-bis[2-(p-dimethylaminophenyl)-2-(p-dimethylaminophenyl)ethenyl]-4,5,6,7-tetrachlorophthalide, 5 parts of 2-anilino-3-methyl-6-N-methyl-N-tetrahydrofurfurylaminofluoran and 1 part of 2-chloro-3-methyl-6-diethylaminofluoran dissolved in 100 parts of 1-phenyl-1-xylylethane was used.

The resulting microcapsule sheet and each of the developer sheets A-1, A-2 and A-3 obtained in Examples 4-1 to 4-3 were combined and tested in the same manner as in Examples 4-1 to 4-4 to evaluate them. The results are shown below in Table 2.

COMPARATIVE EXAMPLES 6 AND 7

The microcapsule sheet obtained in Examples 5-1 to 5-3 and each of the developer sheets B and C obtained in Comparative Examples 4 and 5 were combined and tested in the same manner as in Examples 4-1 to 4-4 to evaluate them. The results are shown below in Table 2

TABLE 2

| Developer Sheet | | Before Irradiation with Fluorescent Lamp | | After Irradiation with Fluorescent Lamp | |
|---|---|---|---|---|---|
| | | PCS Value (800 nm) | Reading with OCR* | PCS Value (800 nm) | Reading with OCR* |
| A-1 | Example 4-1 | 0.74 | ○ | 0.63 | ○ |
| A-2 | Example 4-2 | 0.72 | ○ | 0.61 | ○ |
| A-3 | Example 4-3 | 0.72 | ○ | 0.61 | ○ |
| A-4 | Example 4-4 | 0.73 | ○ | 0.59 | ○ |
| B | Comp. Ex. 4 | 0.65 | ○ | 0.31 | X |
| C | Comp. Ex. 5 | 0.58 | ○ | 0.22 | X |
| A-1 | Example 5-1 | 0.72 | ○ | 0.61 | ○ |
| A-2 | Example 5-2 | 0.71 | ○ | 0.58 | ○ |
| A-3 | Example 5-3 | 0.71 | ○ | 0.60 | ○ |
| B | Comp. Ex. 6 | 0.62 | ○ | 0.28 | X |
| C | Comp. Ex. 7 | 0.55 | ○ | 0.22 | X |

*○: readable
X: not readable

The results in Table 2 show that in the pressure-sensitive sheets of the present invention, the PCS values of the developed color characters were lowered only a small amount after irradiation with a fluorescent lamp and the characters could be read with an OCR. In Comparative Examples, the PCS values were greatly lowered after irradiation and the characters on the sheets could not be read with an OCR.

EXAMPLE 6

Microcapsule sheets were prepared in the same manner as in Examples 4-1 to 4-4 except that each of compounds 11, 12, 17, 25, 27 and 30 as color formers were used in place of the 3,3-bis[2-(p-dimethylaminophenol)-2-(p-methoxyphenyl)ethenyl]-4,5,6,7-tetrachlorophthalide used in Examples 4-1 to 4-4.

Evaluation tests were carried out in the same manner as in Examples 4-1 to 4-4. Good results similar to those obtained in Examples 4-1 to 4-4 were obtained.

It will be understood from the above disclosure that according to the present invention, pressure-sensitive recording sheets can be obtained which give developed color images which can be read with an OCR even when exposed to light.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording sheet for recording and forming high resolution images of characters that can be read with an optical character reader comprising a support, an electron-accepting developer layer, and a substantially colorless electron donating dye layer comprising a microencapsulated divinylphthalide compound represented by formula (I):

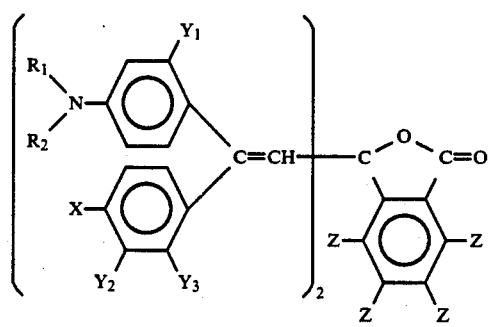

(I)

wherein $R_1$ and $R_2$ each represents an alkyl group having not more than 8 carbon atoms, a cycloalkyl group having 5 to 7 carbon atoms, a benzyl group which may be substituted by a halogen atom or an alkyl group having not more than 4 carbon atoms or a phenyl group which may be substituted by a halogen atom, an alkyl group having not more than 4 carbon atoms, or $R_1$ and $R_2$ are bonded to form a ring together with the N to which they are bonded; X represents a hydrogen atom, a halogen atom, an alkyl group having not more than 8 carbon atoms, an alkoxy group having not more than 8 carbon atoms or $—NR_3R_4$, wherein $R_3$ and $R_4$ have the same meaning as $R_1$ and $R_2$; $Y_1$, $Y_2$ and $Y_3$ each represents a hydrogen atom, a halogen atom, an alkyl group having not more than 8 carbon atoms or an alkoxy group having not more than 8 carbon atoms; and Z represents a hydrogen atom, a chlorine atom or a bromine atom; and wherein the microcapsules have a particle size distribution as follows:

$$4.0\ \mu m \leqq D_{50} \leqq 10.0\ \mu m$$

$$D_{90}/D_{10} \leqq 2.0$$

where $D_{10}$, $D_{50}$ and $D_{90}$ are each the percent particle diameter determined from a cumulative volume distribution as follows:

$D_{10}$:cumulative 10% particle diameter
$D_{50}$:cumulative 50% particle diameter
$D_{90}$:cumulative 90% particle diameter.

2. The pressure-sensitive recording sheet of claim 1, wherein $R_1$ and $R_2$ each represents a methyl group or an ethyl group.

3. The pressure-sensitive recording sheet of claim 1, wherein X represents a hydrogen atom, a chlorine atom, an alkyl group having not more than 8 carbon atoms, an alkoxy group having not more than 3 carbon atoms or $—NR_3R_4$.

4. The pressure-sensitive recording sheet of claim 1, wherein $Y_1$, $Y_2$ and $Y_3$ each represents a hydrogen atom, a chlorine atom, an alkyl group having not more than 4 carbon atoms or alkoxy group having not more than 4 carbon atoms.

5. The pressure-sensitive recording sheet of claim 1, wherein Z represents a hydrogen atom or a chlorine atom.

6. The pressure-sensitive recording sheet of claim 1, wherein 6.5 $\mu m \leqq D_{50} \leqq 8.5$ $\mu m$.

7. The pressure-sensitive recording sheet of claim 1, wherein the divinylphthalide compound is dissolved in a hydrophobic liquid prior to being microencapsulated.

8. The pressure-sensitive recording sheet of claim 1, wherein the electron-accepting developer layer comprises 0.1 to 3.0 g/m$^2$ of a developer.

9. The pressure-sensitive recording sheet of claim 1, wherein the electron-accepting developer layer comprises a metal salt of an aromatic carboxylic acid.

10. The pressure-sensitive recording sheet of claim 1, wherein the electron-donating dye layer includes a fluoran compound having an anilino group at the 2-position and a substituted amino group at the 6-position.

11. The pressure-sensitive recording sheet of claim 10, wherein the fluoran compound is represented by formula (II):

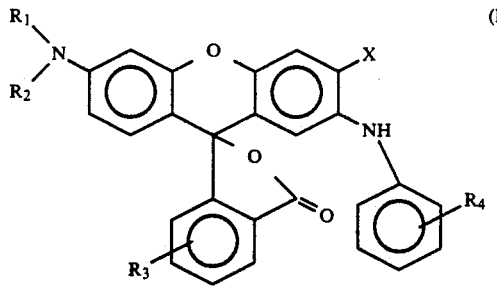

(II)

wherein $R_1$, $R_2$ and $R_3$ each represents an alkyl group having 1 to 10 carbon atoms; $R_4$ represents a hydrogen atom or an alkyl group having 1 to 8 carbon atoms; and X represents an alkyl group having 1 to 8 carbon atoms or a chlorine atom.

12. The pressure-sensitive recording sheet of claim 1, wherein the microcapsules comprise a polyurethane resin.

* * * * *